United States Patent [19]

Mikulecky

[11] Patent Number: 4,949,060

[45] Date of Patent: Aug. 14, 1990

[54] FUSE-ISOLATOR - ACTUATOR

[75] Inventor: Harvey W. Mikulecky, Oconomowoc, Wis.

[73] Assignee: Cooper Power Systems, Inc., Houston, Tex.

[21] Appl. No.: 378,049

[22] Filed: Jul. 11, 1989

[51] Int. Cl.[5] ..... H01H 85/00; H01H 71/20

[52] U.S. Cl. ..... 337/4; 337/2; 337/150

[58] Field of Search ..... 337/4, 5, 148, 150, 337/2; 335/142

[56] References Cited

U.S. PATENT DOCUMENTS

| | | | |
|---|---|---|---|
| 1,130,485 | 3/1915 | Davis | 335/142 |
| 1,740,307 | 12/1929 | Jones . | |
| 1,887,489 | 11/1932 | Hoffer . | |
| 3,043,934 | 7/1962 | Bodenschatz | 337/150 |
| 3,166,894 | 1/1965 | Zmuda et al. | 60/23 |
| 3,544,942 | 12/1970 | Johnson et al. | 337/116 |
| 3,985,988 | 10/1976 | Korner et al. | 200/148 |
| 4,380,001 | 4/1983 | Kassmatsu | 337/4 |
| 4,435,690 | 3/1984 | Link et al. | 335/37 |
| 4,550,298 | 10/1985 | Mikulecky | 335/35 |
| 4,611,189 | 9/1986 | Mikulecky | 335/37 |

*Primary Examiner*—H. Broome

*Attorney, Agent, or Firm*—Michael, Best & Friedrich

[57] ABSTRACT

The invention provides an isolating fusible link, in series with a transformer primary circuit breaker device, for producing an isolating gap after an occurrence of a primary fault condition. More particularly, the invention provides an apparatus comprising a power transformer primary circuit breaker device adapted to be electrically connected in a circuit and including a first contact, and a second contact movable out of engagement with the first contact to open the circuit and movable into engagement with the first contact to close the circuit; and a fuse device including a fusible link connected in electrical series with the breaker device, and adapted to fuse upon an overcurrent condition in the circuit, and structure for moving and maintaining the second current out of engagement with the first contact in response to fusing of the fusible link.

25 Claims, 2 Drawing Sheets

FUSE-ISOLATOR - ACTUATOR

BACKGROUND OF THE INVENTION

This invention relates to power distribution transformers, and more particularly to power distribution transformers incorporating primary circuit breaker devices such as the ones disclosed in U.S. Pat. No. 4,611,189, issued Sept. 9, 1986, and U.S. Pat. No. 4,435,690, issued Mar. 6, 1984. These breaker devices provide primary and secondary current interruption for both extended overloads and fault currents in a transformer, and both include a temperature sensing system responsive to fault current in the primary winding and to increases in temperature of insulating fluid in the transformer, due to overloads or incipient faults. The specifications of U.S. Pat. Nos. 4,611,189 and 4,435,690 are incorporated herein by reference.

A potential problem associated with power distribution transformers incorporating primary circuit breaker devices arises when a re-closing of a transformer having a primary fault is attempted. Although the transformer primary circuit breaker device is designed to operate properly if this is attempted, additional arcing of the faulted area could produce an unsafe condition for the lineman attempting the re-closing.

Attention is directed to the following U.S. Patent references:

| Inventor | Patent No. | Issued |
|---|---|---|
| Jones | 1,740,307 | December 17, 1929 |
| Hoffer | 1,887,489 | November 15, 1932 |
| Zmuda et al. | 3,166,894 | January 26, 1965 |
| Johnsen et al. | 3,544,942 | December 1, 1970 |
| Korner et al. | 3,985,988 | October 12, 1976 |
| Kasamatsu | 4,380,001 | April 12, 1983 |
| Link et al. | 4,435,690 | March 6, 1984 |
| Mikulecky | 4,550,298 | October 29, 1985 |
| Mikulecky | 4,611,189 | September 9, 1986 |

SUMMARY OF THE INVENTION

The invention provides an isolating fusible link, in series with a transformer primary circuit breaker device, for producing an isolating gap after an occurrence of a primary fault condition.

The invention provides not only isolating means, but also means to physically reset the transformer primary circuit breaker device to the open position upon occurrence of a primary fault condition.

More particularly, the invention provides an apparatus comprising a power transformer primary circuit breaker device adapted to be electrically connected in a circuit and including a first contact, and a second contact movable out of engagement with the first contact to open the circuit and movable into engagement with the first contact to close the circuit. The apparatus also comprises a fuse device including a fusible link connected in electrical series with the breaker device and adapted to fuse upon a primary fault overcurrent condition in the circuit, and means for moving the second contact out of engagement with the first contact in response to fusing of the fusible link.

In a preferred embodiment of the invention, means are provided to lock open the primary circuit breaker device upon a primary fault condition, to prevent a lineman from being able to re-close the breaker device.

These and other features and advantages of the invention will become apparent to those skilled in the art upon review of the following detailed description of the preferred embodiment of the invention, reference being made to the appended drawings.

Figure 1:
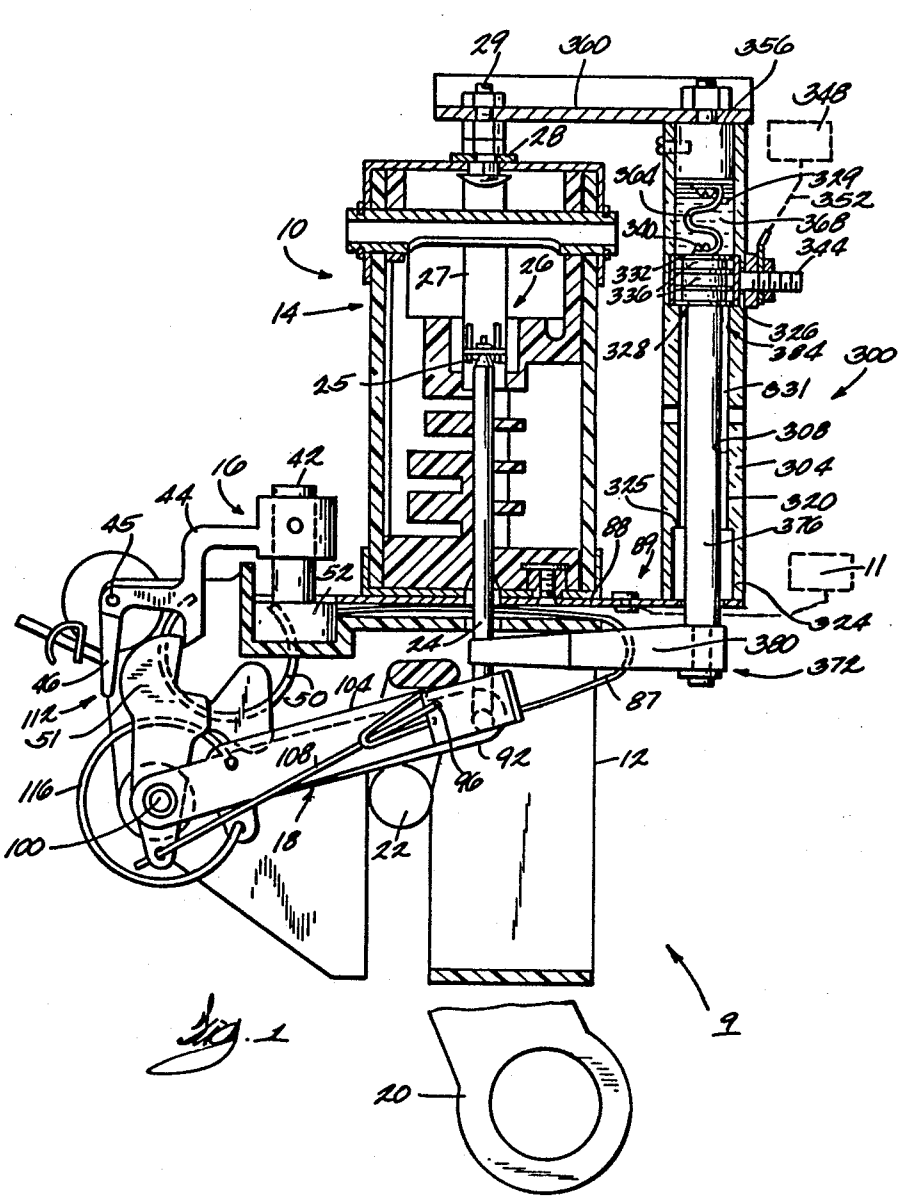
FIG. 1 is a side elevational view, partially in section, of a transformer primary breaker device and fuse device embodying the invention.

Before at least one embodiment of the invention is explained in detail, it is to be understood that the invention is not limited in its application to the details of construction and the arrangements of components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

DETAILED DESCRIPTION OF THE PREFERRED EMBODIMENT OF THE INVENTION

FIG. 1 shows an apparatus 9 embodying the invention. The apparatus 9 includes a primary circuit breaker device 10 that is generally located in a tank of a power transformer (not shown), which power transformer includes a primary winding 11 (shown schematically). The circuit breaker device 10 is adapted to be electrically connected in a circuit including the primary winding 11 to provide a current path in electrical series with the power transformer primary winding 11 The circuit breaker device 10 includes a frame or base 12, an arc interrupting assembly 14, a current sensing assembly 16, a latch mechanism 18 including an actuating handle 20 and a crankshaft 22 connected to the handle 20, and a contact defined by a conductive rod 24 having an arc tip 25, all of which generally operate as disclosed in U.S. Pat. No. 4,611,189.

The arc interrupting assembly 14 includes a contact defined by a contact assembly 26. The contact assembly 26 includes a conductive strip 27 having a upper end bent to form a mounting flange 28, and the contact assembly 26 further includes an electrical post 29. The current path provided by the circuit breaker device 10 is open when the conductive rod 24 is not in engagement with the contact assembly 26 and is closed when the conductive rod 24 is in engagement with the contact assembly 26. During normal operation of the transformer, the current path provided by the circuit breaker device 10 is closed.

The current sensing assembly 16 includes a magnet 42 mounted on the end of a crank arm 44, which is pivotally mounted on the base 12 by a pin 45. The crank arm 44 supports a depending member 46. The crank arm 44 is biased in a counterclockwise direction by means of a spring 50 to move the magnet 42 to an open position.

The depending member 46 on the crank arm 44 will move into engagement with a trip lever 51, which is described below, when the magnet 42 is released from a temperature sensing element 52. The magnet 42 is released from the temperature sensing element 52 if the temperature sensing element 52 reaches the Curie temperature of the magnet 42. The current sensing assembly 16 further includes an insulated conductor 87 connecting the temperature sensing element 52 to the conductive rod 24. The current sensing assembly 16 also includes a metal plate 88 to which the primary winding 11 of the transformer is electrically connected by a connector 89. The temperature sensing element 52 is also electrically connected to the primary winding 11 at the connector 89.

The latch mechanism 18 includes a first lever arm 92 which defines a catch ledge 96 and which is operably connected to the conductive rod 24 and pivotally mounted on a shaft 100. The mechanism 18 also includes a second lever arm 104 that is also pivotally mounted on the shaft 100 and that supports a rod 108 for movement into engagement with the first lever arm 92 to lock the lever arms 92 and 104 together.

The second lever arm 104 is released from the first lever arm 92 by means of a trip assembly 112, which includes the above-mentioned trip lever 51 and which is pivotally mounted on the shaft 100 and operably connected to the rod 108. The trip lever 51 is positioned to engage the depending member 46. It should be apparent that upon rotation of the trip lever 51 in the clockwise direction, the rod 108 is pulled away from the catch ledge 96 on the first lever arm 92, which arm is biased clockwise by a spring 116 included in the trip assembly 112, to move the conductive rod 24 away from the contact assembly 26. The trip lever 51 is tripped by the current sensing assembly 16 if the magnet 42 is released from the temperature sensing element 52.

The latch mechanism 18 can be used to separate the conductive rod 24 from the contact assembly 26 to manually open the primary circuit breaker device, externally of the transformer with which the primary circuit breaker device is used, by means of the actuating handle 20. The actuating handle 20 is connected to the crankshaft 22, which crankshaft rotatably engages the second lever arm 104. When the actuating handle 20 is manually actuated, the crankshaft 22 engages the second lever arm 104 so that the rod 34 is pulled away from the catch ledge 96 and the conductive rod 24 is moved away from the contact assembly 26, as described in detail in U.S. Pat. No. 4,435,690.

The apparatus 9 further includes, attached to the primary circuit breaker device 10 and in electrical series connection therewith, a fuse isolator device 300.

The fuse device 300 comprises a cylinder 304 defining a bore 308 including a first or upper section 320 having a first inner diameter, and a second or lower section 324 having a second inner diameter greater than the first inner diameter for a purpose that will later be described in more detail. A step or shoulder 325 divides the upper and lower sections. The cylinder 304 further includes an electrically conductive ring 326 for a purpose that will later be described.

The device 300 also comprises a piston 328 which is slidably housed in the bore 308 and which divides the bore 308 into a first or upper chamber 329 and a second or lower chamber 331. The piston 328 comprises contact springs including a plurality of electrically conductive disks 332 stamped from a metal such as beryllium copper or phosphor bronze, and a plurality of spacers 336 separating the conductive disks 332, having respective diameters that are less than the diameters of the conductive disks and that allow the conductive disks 332 to flex. At least one of the conductive disks 332 is in electrical connection with the conductive ring 326 when the conductive rod 24 is in engagement with the contact assembly 26.

Movement of the piston 328 toward the lower section 324 causes the disks 332 to become deformed, and movement of the piston 328 completely into the lower section 324 causes the disks 332 to expand radially outwardly so that subsequent upward movement of the piston 328 causes the disks 332 to engage the shoulder 325 and to substantially prevent reentry of the piston 328 into the upper section 320 of the bore 308. Further, the conductive disks 332 provide a seal with the cylinder 304 to substantially prevent any material from flowing between the first chamber 329 and the second chamber 331. The piston 328 further comprises a fastener or screw 340 connecting the conductive disks 332 and the spacers 336. A portion of the fastener 340 defines a guide member 342.

The fuse device 300 further includes an electrical post 344 connected to the conductive ring 326 and adapted to be connected to a high voltage bushing 348 via a conductor 352.

The fuse device 300 also comprises an electrical post 356 which closes the upper end of the cylinder 304 and which is adapted to electrically connect the fuse device 300 to the breaker device 10. More particularly, the cylinder 304 is connected to the breaker device 10 by an electrically conductive mounting channel 360 that supports the electrical post 29 of the breaker device 10 and the electrical post 356 of the fuse device 300.

The fuse device 300 further includes a fusible link 364 located in the upper chamber 329 and connected between the electrical post 356 and the fastener 340 to allow an electrical series connection to be made from the breaker device 10 to the high voltage bushing 348 via the conductor 352, the electrical post 344, the conductive ring 326, at least one of the disks 332, the fastener 340, the fusible link 364, the electrical post 356, and the mounting channel 360. The fusible link 364 is adapted to fuse upon a primary fault overcurrent condition in the transformer primary 11. Fusing of the fusible link 364, due to an overcurrent condition, results in production of an arc.

The fuse device 300 further includes means for moving the conductive rod 24 out of engagement with the contact assembly 26 in response to production of the arc. More particularly, the moving means includes means for moving the piston 328 downwardly or in the direction increasing the volume of the upper chamber 329 in response to fusing of the fusible link 364. Still more particularly, the means for moving the piston 328 comprises material 368 located in the upper chamber 329 and adapted to expand in response to fusing of the fusible link 364. The material 368 should be selected such that it rapidly vaporizes in response to heat produced by the arc and produces sufficient force to break any weld that may have formed between the conductive rod 24 and the contact assembly 26.

The moving means further includes a mechanical link 372 communicating with the piston 328 and the conductive rod 24 such that the conductive rod 24 is moved out of engagement with the contact assembly 26 in response to downward movement of the piston 328. As shown in FIG. 1, the mechanical link 372 comprises an insulated rod 376 which is connected to the piston 328 by the screw 340, and an arm 380 which extends obliquely from the lower of the rod 376 and adjacent to the conductive rod 24. More particularly, the arm 380 includes spaced legs extending on opposite sides of the rod 24 and above the lever arm 104, so that downward movement of the arm 380 causes the arm 380 to engage the lever arm 104 and to thereby move the rod 24 downwardly and out of contact with the conductive assembly 26, but downward movement of the rod 24 does not cause movement of the arm 380.

The piston 328 is located at least partially in the upper section 320 of the bore 308 when the conductive rod 24 is in engagement with the contact assembly 26, and the conductive rod 24 is moved out of engagement with the contact assembly 26 in response to downward movement of the piston 328 completely into the lower section 324 of the bore 308. The arc is initially produced between the electrical post 356 and the disks 332 and/or the ring 326. After the piston 328 moves past the ring 326, the arc transfers to extend between the ring 326 and the electrical post 356.

Figure 3:
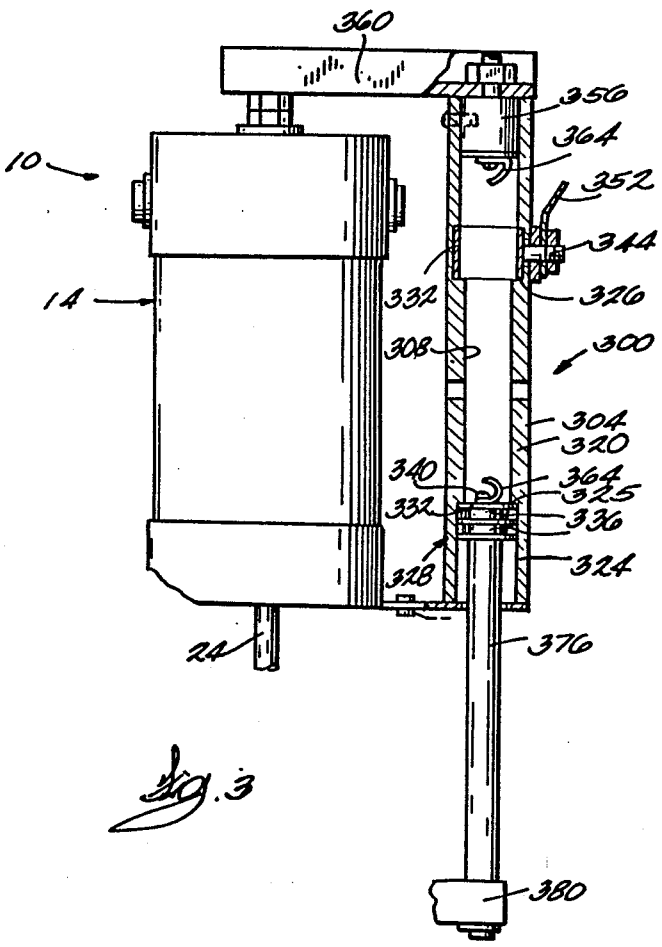
FIG. 3 is a broken away side elevational view, partially in section, showing the fuse device of FIG. 1 after fusing due to an overcurrent condition.

The fuse device 300 further includes means for preventing movement of the conductive rod 24 into engagement with the contact assembly 26 after the conductive rod 24 moves out of engagement with the contact assembly 26. This means preferably comprises means for preventing movement of the piston 328 upwardly or in the direction decreasing the volume of the upper chamber 329 after the conductive rod 24 moves out of engagement with the contact assembly 26. In the preferred embodiment, as explained above, the piston 328 expands radially outwardly after it moves completely into the lower section 324, and engagement of the piston 328 with the shoulder prevents upward movement of the piston 328 (see FIG. 3).

Figure 2:
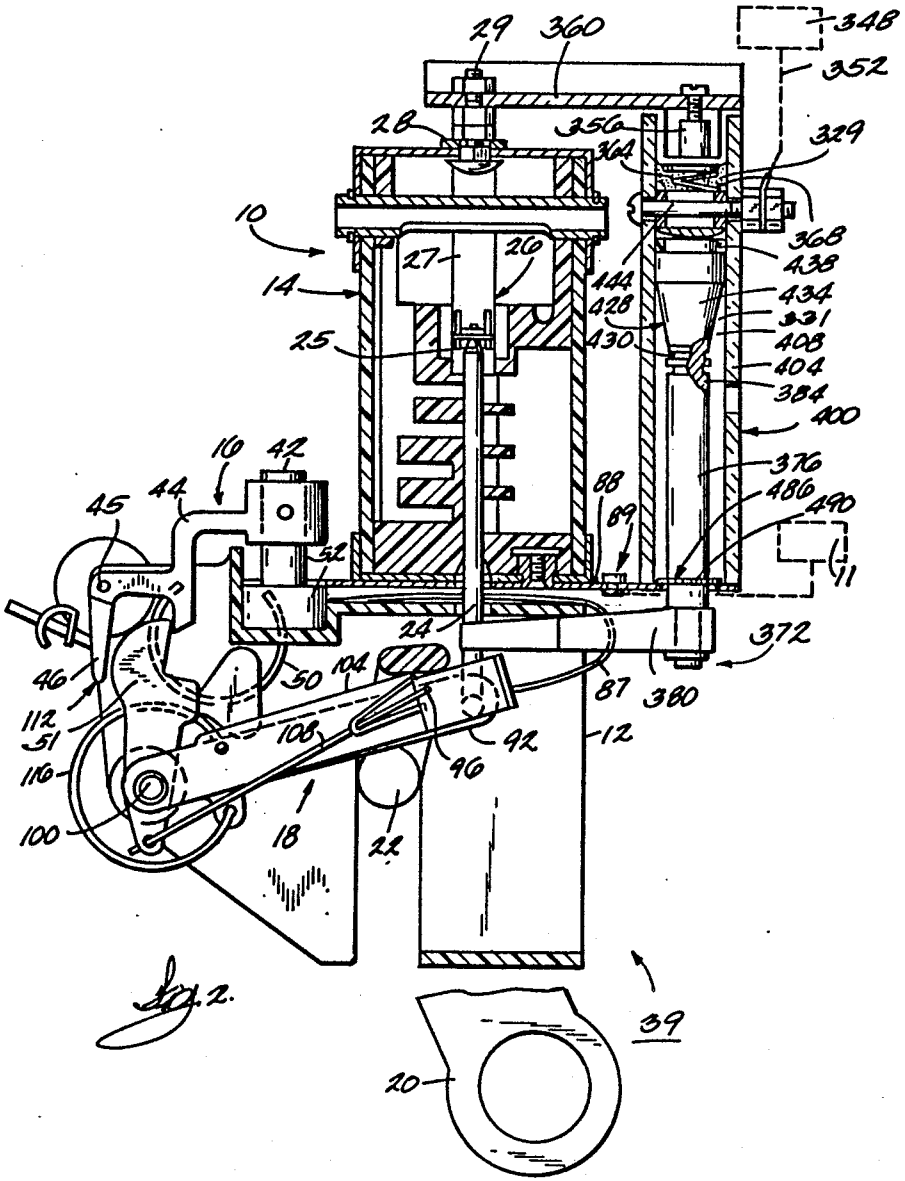
FIG. 2 is a side elevational view in section of an alternate transformer primary breaker device and fuse device embodying the invention.

FIG. 2 shows an apparatus 399 that is an alternate embodiment of the invention, which embodiment is preferred over the embodiment shown in FIG. 1. Except as described hereinafter, the apparatus 399 is substantially identical to the apparatus 9 shown in FIG. 1, and common elements have been given the same reference numerals.

The apparatus 399 shown in FIG. 2 includes a fuse isolator device 400. The fuse device 400 comprises a cylinder 404 defining a bore 408 having a substantially constant inner diameter. A piston 428 divides the bore 408 into the upper chamber 329 and the lower chamber 331. The piston 428, which is an integral part of the rod 376, includes a recess 430, which is preferably a circumferential groove, and a tapered portion 434, the reasons for which will later be described. The piston 428 also includes an 0-ring 438 that substantially prevents any material in the upper chamber 329 from migrating into the lower chamber 331, and vice versa.

The fuse device 400 does not include the electrically conductive ring 326 or the electrical post 344 of the fuse device 300. Instead, the fuse device 400 has an electrical post 444, and the fusible link 364 is connected between the electrical posts 356 and 444 of the fuse device 400. Upon fusing of the fusible link 364, an arc is produced between the electrical posts 356 and 444.

Figure 4:
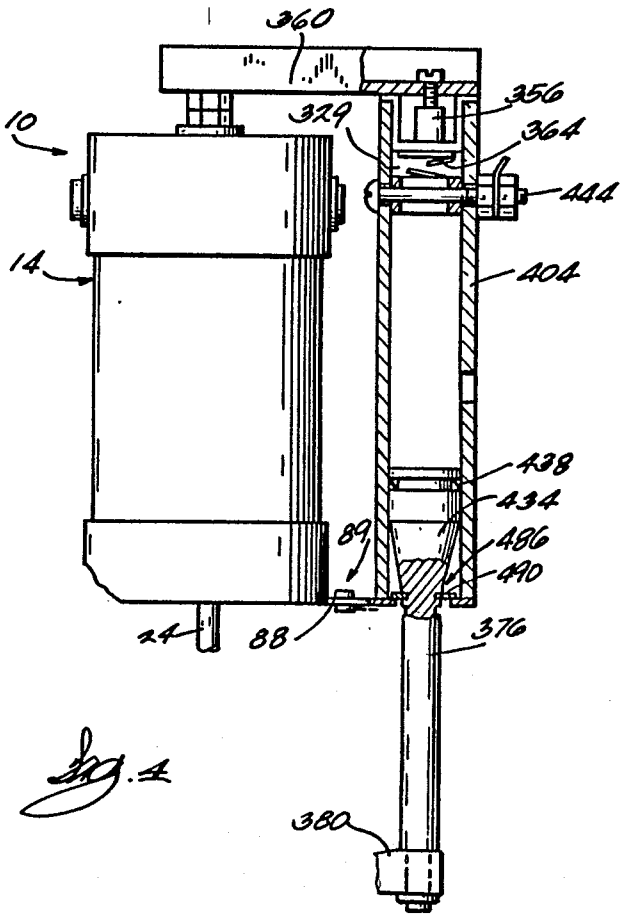
FIG. 4 is a broken away side elevational view, partially in section, showing the fuse device of FIG. 2 after fusing due to an overcurrent condition.

In the fuse device 400, the means for preventing movement of the piston 428 upwardly or in the direction decreasing the volume of the upper chamber 329 comprises the recess 430, and a spring finger piece 490 which is mounted to the metal plate 88 of the breaker device 10 (and thus is fixed in position with respect to the cylinder 404) and which has thereon a plurality of projections 486 that extend into the recess 430 in response to downward movement of the piston 428, thereby preventing upward movement of the piston 428 (see FIG. 4). The projections 486 face generally away from the piston 428, or downwardly in FIG. 2, and simultaneously face radially inwardly to exert a radially inward force on the insulated rod 376 so as to generally support the rod 376. The tapered portion 434 of the piston 428 engages the piece 490 to limit downward travel of the piston 428. Thereafter, upward movement of the piston 428 causes the projections 486 to engage the recess 430 and thereby prevent further upward movement of the piston 428.

Various of the features of the invention are set forth in the following claims.

I claim:

1. An apparatus comprising:

a power transformer primary circuit breaker device adapted to be electrically connected in a circuit and including a first contact, a second contact movable out of engagement with said first contact to open the circuit and movable into engagement with said first contact to close the circuit, and temperature out of engagement with said first contact in response to a fault condition in the circuit; and a fuse device including a fusible link connected in electrical series with the breaker device, and adapted to melt upon an overcurrent condition in the circuit, and means separate from said trip means and for moving said second contact out of engagement with said first contact in response to fusing out of said fusible link, wherein melting of said fusible link produces an arc, and wherein production of the arc causes said means separate from said trip means to move said second contact out of engagement with said first contact.

2. An apparatus in accordance with claim 1 wherein said fuse device further includes means for preventing movement of said second contact into engagement with said first contact after said moving means moves with second contact out of engagement with said first contact.

3. An apparatus in accordance with claim 1 wherein said fuse device also includes a cylinder defining a bore, and a piston dividing the bore into a first chamber and a second chamber, wherein said fusible link is located in said first chamber, and wherein said moving means further includes means for moving said piston in the direction increasing the volume of said first chamber in response to melting of said fusible link.

4. An apparatus in accordance with claim 3, wherein said moving means further includes a mechanical link communicating with said piston and said second contact such that said second contact is moved out of engagement with said first contact in response to movement of said piston in the direction increasing the volume of said first chamber.

5. An apparatus in accordance with claim 3 wherein said means for moving said piston comprises material located in said first chamber and adapted to expand in response to melting of said fusible link.

6. An apparatus in accordance with claim 5 wherein said fusible link produces an arc upon melting, and wherein said material vaporizes in response to heat produced by the arc.

7. An apparatus in accordance with claim 4 wherein said fuse device further includes means for preventing movement of said second contact into engagement with said first contact after said second contact moves out of engagement with said first contact, said means for preventing movement of said second contact into engagement with said first contact comprising means for preventing movement of said piston in the direction decreasing the volume of said first chamber.

8. An apparatus in accordance with claim 7 wherein said piston has therein a recess, and wherein said means for preventing movement of said piston comprises said recess, and a projection which is fixed in position with respect to said cylinder and which extends into said recess in response to movement of said piston in the direction increasing the volume of said first chamber, thereby preventing movement of said piston in the direction decreasing the volume of said first chamber.

9. An apparatus in accordance with claim 7 wherein said bore further includes a first section having a first inner diameter, and a second section having a second inner diameter greater than said first inner diameter, wherein said piston is located at least partially in said first section when said second contact is in engagement with said first contact, wherein said second contact is moved out of engagement with said first contact in response to movement of said piston completely into said second section, and wherein said piston expands radially outwardly upon complete movement thereof into said second section, thereby preventing movement of said piston in the direction decreasing the volume of said first chamber.

10. A fuse device for use with a power transformer breaker device adapted to be electrically connected in a circuit and including a first contact, and a second contact movable into and out of engagement with the first contact for respectively closing and opening the circuit; said fuse device comprising a cylinder defining a bore, a piston, dividing the bore into a first chamber, and a second chamber, a fusible link in said first chamber, adapted to be connected in electrical series with the power transformer breaker device and adapted to fuse upon an overcurrent condition in the circuit, and means for moving the second contact out of engagement with the first contact in response to fusing of said fusible link and including means for moving said piston in the direction increasing the volume of said first chamber.

11. An apparatus in accordance with claim 10 in electrical series connection with a transformer primary.

12. An apparatus for use with a power transformer having a primary side, said apparatus comprising:

a power transformer breaker device adapted to be electrically connected in series with the primary side to define a portion of a circuit including the power transformer primary side, when said apparatus is in use, said breaker device further including a contact assembly and a conductive rod defining the portion of the circuit, said conductive rod being movable out of engagement with said contact assembly to open the circuit and moveable into engagement with said contact assembly to close the circuit; and a fuse device including a cylinder defining a bore, a piston dividing the bore into a first chamber and a second chamber, a mechanical link between said piston and said conductive rod and adapted to move said conductive rod out of engagement with said contact assembly in response to movement of said piston in the direction increasing the volume of said first chamber, a fusible link in said first chamber and in electrical series connection with the portion of the circuit, and adapted to fuse upon an overcurrent condition in the circuit, and material located in said first chamber and adapted to expand in response to fusing of said fusible link, thereby moving said piston in the direction increasing the volume of said first chamber.

13. An apparatus comprising:

a power transformer primary circuit breaker device adapted to be electrically connected in a circuit and including a first contact, and a second contact movable out of engagement with said first contact to open the circuit and movable into engagement with said first contact to close the circuit; and a fuse device including a cylinder defining a bore, a piston dividing the bore into a first chamber and a second chamber, a fusible link in said first chamber, connected in electrical series with the breaker device, and adapted to fuse upon an overcurrent condition in the circuit, and means for moving said second contact out of engagement with said first contact in response to fusing of said fusible link and including means for moving said piston in the direction increasing the volume of said first chamber.

14. An apparatus in accordance with claim 13 wherein fusing of said fusible link produces an arc, and wherein said moving means moves said second contact in response to production of the arc.

15. An apparatus in accordance with claim 13 wherein said fuse device further includes means for preventing movement of said second contact into engagement with said first contact after said moving means moves said second contact out of engagement with said first contact.

16. An apparatus in accordance with claim 13 wherein said moving means further includes a mechanical link communicating with said piston and said second contact such that said second contact is moved out of engagement with said first contact in response to movement of said piston in the direction increasing the volume of said first chamber.

17. An apparatus in accordance with claim 13 wherein said means for moving said piston comprises material located in said first chamber and adapted to expand in response to fusing of said fusible link.

18. An apparatus in accordance with claim 17 wherein said fusible link produces an arc upon fusing, and wherein said material vaporizes in response to heat produced by the arc.

19. An apparatus in accordance with claim 16 wherein said fuse device further includes means for preventing movement of said second contact into engagement with said first contact after said second contact moves out of engagement with said first contact, said means for preventing movement of said second contact into engagement with said first contact comprising means for preventing movement of said piston in the direction decreasing the volume of said first chamber.

20. An apparatus in accordance with claim 19 wherein said piston has therein a recess, and wherein said means for preventing movement of said piston comprises said recess, and a projection which is fixed in position with respect to said cylinder and which extends into said recess in response to movement of said piston in the direction increasing the volume of said first chamber, thereby preventing movement of said piston in the direction decreasing the volume of said first chamber.

21. An apparatus in accordance with claim 19 wherein said bore further includes a first section having a first inner diameter, and a second section having a second inner diameter greater that said first inner diameter, wherein said piston is located at least partially in said first section when said second contact is in engagement with said first contact, wherein said second contact is moved out of engagement with said first contact in response to movement of said piston completely into said second section, and wherein said piston expands radially outwardly upon complete movement thereof into said second section, thereby preventing movement of said piston in the direction decreasing the volume of said first chamber.

22. An apparatus for use with a power transformer having a primary side, said apparatus comprising:

a power transformer breaker device adapted to be electrically connected in series with the primary side to provide a current path in electrical series with the power transformer primary side, when said apparatus is in use, said breaker device further including mechanical means for selectively serving the current path, said means for selectively serving the current path including a contact assembly and a conductive rod movable out of engagement with said first contact to severe the current path; and a fuse device including a fusible link in electrical series with said power transformer breaker device, said fusible link being adapted to fuse when current flow through the current path exceeds a predetermined amount, said fuse device further including means operable on said mechanical means for severing the current path in response to fusing of said fusible link, said means in said fuse device for mechanically severing said current path including a cylinder, a piston slidably housed in said cylinder and defining a first chamber and a second chamber in said cylinder, said first chamber housing said fusible link, and an insulating rod which is movable with said piston and which is attached to said conductive rod so as to separate said conductive rod from said contact assembly in response to movement of said piston consequent to fusing of said fusible link.

23. An apparatus in accordance with claim 22 wherein said first chamber houses material adapted to expand in response to fusing of said fusible link, wherein fusing of said fusible link produces an arc, and wherein said material expands in response to heat produced by the arc.

24. An apparatus in accordance with claim 22 in electrical series connection with a transformer primary.

25. An apparatus comprising:

a power transformer having a primary side;

a power transformer breaker device electrically connected in series with said primary side to define a portion of a circuit including said power transformer primary side, when said apparatus is in use, said breaker device further including a contact assembly and a conductive rod defining the portion of the circuit, said conductive rod being movable out of engagement with said contact assembly to open the circuit and movable into engagement with said contact assembly to close the circuit; and a fuse device including a cylinder defining a bore, a piston dividing the bore into a first chamber and a second chamber, a mechanical link between said piston and said conductive rod and adapted to move said conductive rod out of engagement with said contact assembly in response to movement of said piston in the direction increasing the volume of said first chamber, a fusible link in said first chamber and in electrical series connection with the portion of the circuit, and adapted to fuse upon and overcurrent condition in the circuit, and material located in said first chamber and adapted to expand in response to fusing of said fusible link, thereby moving said piston in the direction increasing the volume of said first chamber.

* * * * *

UNITED STATES PATENT AND TRADEMARK OFFICE

CERTIFICATE OF CORRECTION

PATENT NO. : 4,949,060

DATED : August 14, 1990

INVENTOR(S) : Harvey W. Mikulecky

It is certified that error appears in the above-identified patent and that said Letters Patent is hereby corrected as shown below:

Column 6, line 26, after the word "temperature" insert --responsive trip means for moving said second contact--

Column 6, line 42, the word "with" should read --said--

Signed and Sealed this

Twenty-eighth Day of April, 1992

*Attest:*

HARRY F. MANBECK, JR.

*Attesting Officer*

*Commissioner of Patents and Trademarks*